US005813952A

United States Patent [19]

Lochbaum

[11] Patent Number: 5,813,952

[45] Date of Patent: Sep. 29, 1998

[54] UNDER WATER EXERCISE DEVICES

[76] Inventor: Kenneth Lochbaum, 3002 E. 38th St., Erie, Pa. 16510

[21] Appl. No.: 772,420

[22] Filed: Dec. 23, 1996

Related U.S. Application Data

[60] Division of Ser. No. 451,674, May 26, 1995, Pat. No. 5,611,763, which is a continuation-in-part of Ser. No. 365, 498, Dec. 28, 1994, Pat. No. 5,533,950.

[51] Int. Cl.[6] ..... A63B 21/008

[52] U.S. Cl. ..... 482/111

[58] Field of Search ..... 422/111; 434/254; 472/128; 405/186; 128/201.11, 201.27

[56] References Cited

U.S. PATENT DOCUMENTS

| | | | |
|---|---|---|---|
| 2,875,528 | 3/1959 | Garate . | |
| 3,415,475 | 12/1968 | Goodman . | |
| 3,861,675 | 1/1975 | Hopper . | |
| 4,145,044 | 3/1979 | Wilson et al. . | |
| 4,170,799 | 10/1979 | Ratelband . | |
| 4,247,096 | 1/1981 | Schmitt . | |
| 4,427,385 | 1/1984 | Galerne | 434/254 |
| 4,759,544 | 7/1988 | Diaz . | |
| 4,784,385 | 11/1988 | D'Angelo . | |
| 5,219,317 | 6/1993 | Beasley . | |
| 5,242,352 | 9/1993 | Elliott . | |
| 5,372,564 | 12/1994 | Spirito . | |
| 5,471,976 | 12/1995 | Smith | 128/201.27 |
| 5,535,734 | 7/1996 | Le et al. | 128/201.27 |
| 5,606,967 | 3/1997 | Wang | 128/201.11 |

*Primary Examiner*—Lynne A. Reichard
*Attorney, Agent, or Firm*—Lovercheck and Lovercheck

[57] ABSTRACT

The stabilizer devices for aquatic deep water exercise and a device for aquatic exercise are disclosed. The stabilizers may be fixed to the side walls or bottom of a container of water to hold a person in an exercising position. The stabilizers may be portable or fixed permanently in position on a container of water. The stabilizers may be rigid or flexible, may be completely immersed in water. An air supply for under water breathing is provided.

22 Claims, 1 Drawing Sheet

UNDER WATER EXERCISE DEVICES

This application is a Division of Ser. No. 08/451,674, filed May 26, 1995, now U.S. Pat. No. 5,611,763 which is a continuation-in-part application of Ser. No. 08/365,498 filed Dec. 28, 1994 now U.S. Pat. No. 5,533,950.

BACKGROUND OF THE INVENTION

An ordinary person can live for only a short time under water without air or oxygen. A person can remain under water longer if he does not move his muscles. Even when remaining perfectly quiet a person can stay under water only a very few minutes without air or oxygen. During a strenuous exercise a person can remain submerged an even lesser time.

Applicant has provided an air supply for a submerged person so that the person can do exercises and remain completely submerged in water. His body can also be held in a stabilized position while the person is exercising.

Applicant's drawings show examples of air supplies, exercise devices and stabilizing devices which can be permanent, portable or temporary, according to the way they are attached to the side or bottom of the pool.

Applicant is aware of the following U.S. Patents: U.S. Pat. No. 2,875,528 to Garate; U.S. Pat. No. 3,415,475 to Goodman; U.S. Pat. No. 3,861,675 to Hopper; U.S. Pat. No. 4,145,044 to Wilson; U.S. Pat. No. 4,170,799 to Ratelband; U.S. Pat. No. 4,247,096 to Schmitt; U.S. Pat. No. 4,759,544 to Diaz; U.S. Pat. No. 4,784,385 to D'Angelo; U.S. Pat. No. 5,219,317 to Beasley; U.S. Pat. No. 5,242,352 to Elliott; and, U.S. Pat. No. 5,372,564 to Spirito.

SUMMARY OF THE INVENTION

Applicant has provided several examples of stabilizers which may be used by an exerciser to support themselves in water in an exercise position relative to the exercise device. The air supply and exercising devices can be used at all times when the person is submerged. The stabilizers may be secured to a base and provide a structure to engage the exerciser. A structure may be provided to engage the foot of the exerciser or may be provided to engage other parts of the body of the exerciser in a standing, sitting or other position. Flexible straps may be provided to secure the exerciser to the stabilizer.

It is an object of the present invention to provide a stabilizer for aquatic exercise and to provide an air supply that is simple in construction, economical to manufacture and simple and efficient to use.

It is another object of the present invention to provide an aquatic stabilizer that can be fixed in position in a body of water and the body of a person can engage the stabilizer to hold the body in exercise position in the water.

It is another object of the present invention to provide an aquatic air supply.

It is another object of the present invention to provide an aquatic exercise air supply that can be used in deep water and while the person exercising is fully immersed in the water.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

BRIEF DESCRIPTION OF THE DRAWING(S)

DESCRIPTION OF THE PREFERRED EMBODIMENT(S)

Figure 1:
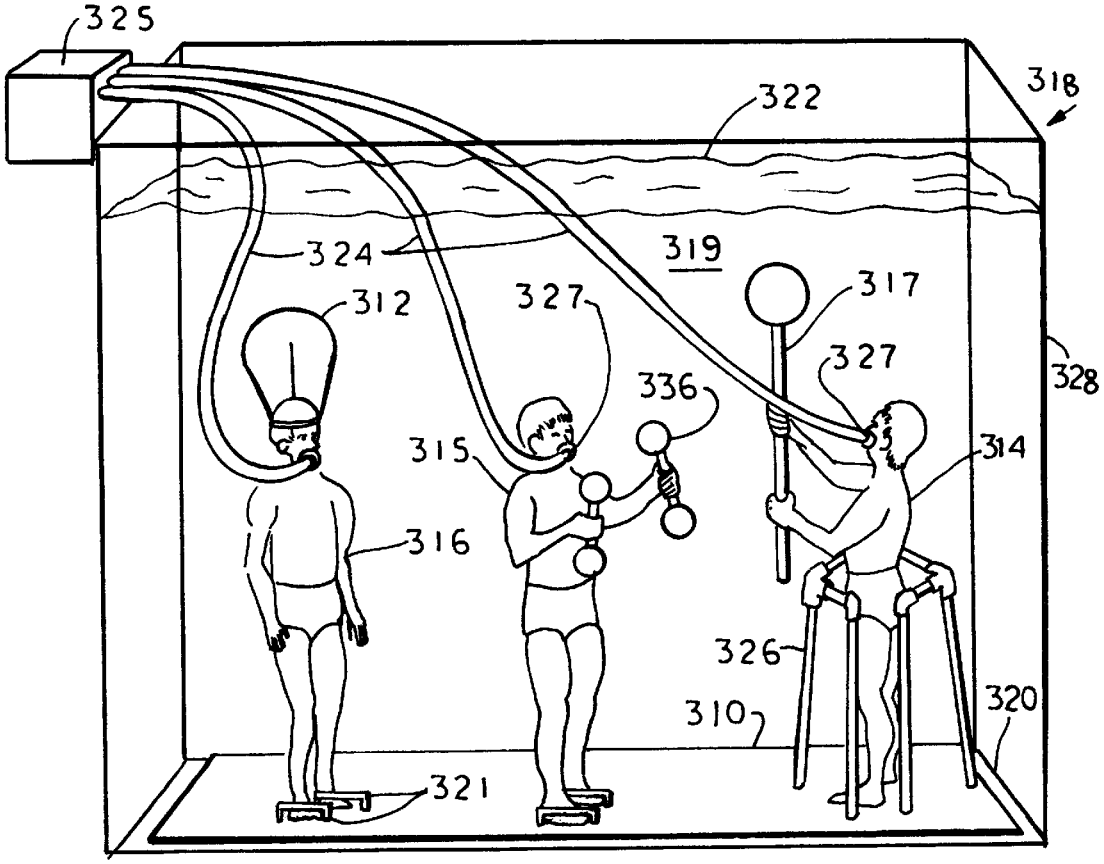
FIG. 1 is a side view of a deep pool showing air being supplied to persons exercising who are secured in an exercise position with a stabilizer.

Now with more particular reference to the drawings, FIG. 1 shows a deep water exercise pool where persons exercising 314,315,316 are completely immersed in water 319. Pool or container of water 318 has pool sides 328. Water 319 is sufficiently deep from bottom 320 to top surface 322 so that the person exercising may use a water resistant device such as golf club 317 above his head without the water resistance device leaving or partially leaving water 319. Therefore, the resistance function of the device is maintained throughout the exercise. Base 310 may be placed on bottom 320 on which foot stabilizers 321 may be fixed to bottom 320 or releasably secured to base 310 to support persons exercising 314,315,316 in exercise positions. Air supply lines 324 supply air to persons exercising 314,315, 316 from air supply means 325. Air is breathed by persons exercising 314,315,316 through air regulator 327. Torso engaging stabilizer means 326 comprises upright members which partially surround person exercising 314 to secure him in an exercise position. The person may be secured to or engaged by the stabilizer means.

Exercise person 314 is exercising with water resistance golf club 317 or other water resistant handled sports implement such as a tennis racquet, bat and so on. Exercise person 315 is exercising with hand held water resistant devices which are useful for simulated exercises. Exercise person 316 has neck exercising device 312 comprising water resistant member upwardly extending from head engaging attachment which secures device to the head of exercise person 316 whereby the neck may be exercised by movement of resistance member through water 319.

Figure 2:
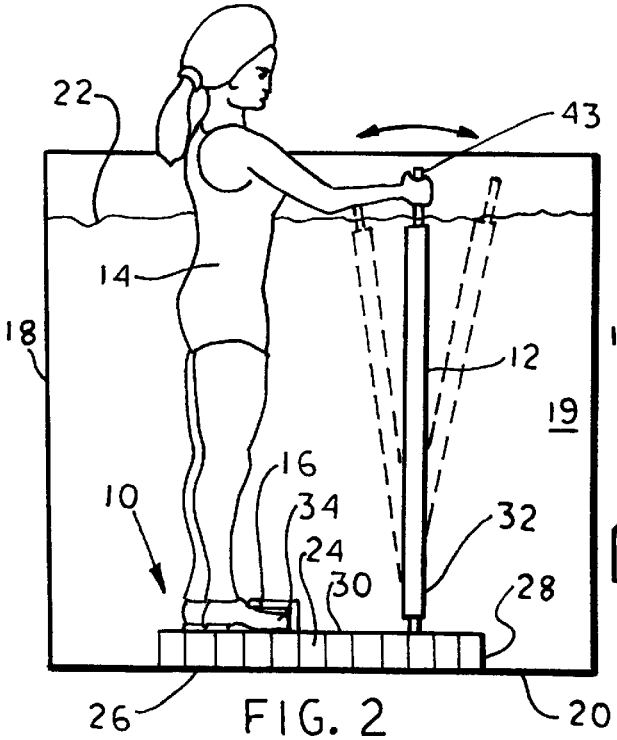
FIG. 2 is a side view of a container of water with one side wall of the container removed showing an exercising device supported on a base and a foot stabilizer according to the invention.

FIG. 2 shows base member 10 supporting exercise device 12. Person 14 is supported in an exercise position on base member 10 by aquatic foot stabilizer device 16. In the example shown in FIG. 2, exercise device 12 may be made of plastic plumbing fittings of a type familiar to those skilled in the art.

Without foot stabilizer device 16, person 14 would not be able to maintain a stationary exercising position due to the buoyancy of water 19. Container 18 of water 19 could be a pool, exercise tank, pond, lake or river for example. Water 19 has top surface 22 and a depth between bottom 20 and top surface 22 sufficient to provide an aquatic exercise environment.

Base member 10 may cover the entire bottom 20 or a part thereof. Base member 10 may be permanently attached or removably attached to bottom 20. Base member 10 may be made of short pieces of plastic pipe 24 set on end and attached together by suitable adhesive to form a flat top surface with continuous equally spaced openings 30 disposed in rows and columns to receive posts 32,34 for stabilizing on exercise device 12. Openings 30 in top 24 also provide a wide range of positions for exercise device 12 and for foot stabilizer device 16.

Figure 3:
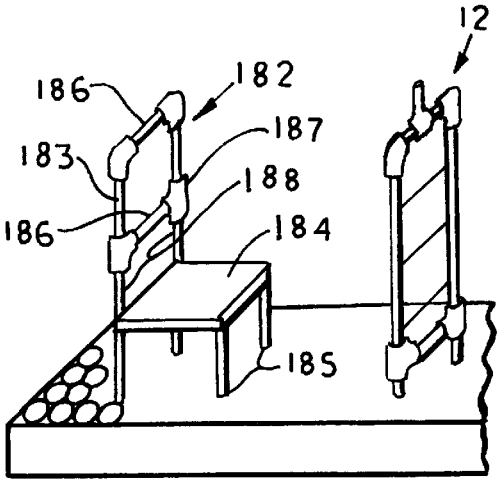
FIG. 3 is an isometric view of a base having a chair stabilizer and an exercise device.

FIG. 3 shows exercise device 12. Chair 182 has upright members 183, seat 184 and legs 185. Legs 185 are attached to the corners of seat 184. Upright members 183 are rigidly supported generally parallel to each other by cross members 186 and T-fittings 187. Lower ends of upright members 183 and legs 185 are received in openings 30 in base 10. One or more belts 188 may be provided to secure person 14 in a desired exercise position on chair 182.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A deep water exercise pool having a bottom and side walls whereby a completely immersed exercising person can use an exercise device above his head without the device reaching the surface of the water while exercising;

a body engaging stabilizer means on said bottom of said pool to hold said person in place while exercising; and, an air supply and a breathing means connecting the exercising person to said air supply, said air supply means supported adjacent said pool to supply air to the exercising person from outside said pool.

2. The pool recited in claim 1 wherein a base is secured to said bottom of said pool and a stabilizing means for engaging the body of the person for holding the person in place is supported on said base.

3. The pool recited in claim 2 wherein said stabilizing means comprises foot engaging means attached to said base to hold a foot of the person in place.

4. The pool recited in claim 2 wherein said stabilizing means comprises a chair attached to said base; and, said chair having an attaching means for attaching a flexible belt thereto for stabilizing said person.

5. The pool recited in claim 2 wherein said stabilizing means comprises spaced leg members secured to said base; and, a body engaging means on said leg members for engaging the mid section of the body of said person using said pool.

6. A deep water exercising pool having a depth whereby an individual may be completely immersed in water while exercising with a golf club simulated device;

said pool having a bottom and side walls;

a body engaging stabilizing means supported on said bottom for engaging the body for stabilizing said individual in the water;

an air supply means being supported adjacent said pool to supply air to the exercising person from outside said pool;

said air supply means having a connecting means to connect breathing equipment to the individual's face whereby the individual can be supplied air while exercising under the water.

7. The pool recited in claim 1 wherein said golf club simulated device having a water resistant device to be swung above the head of a user whereby the resistance function of said device is maintained throughout an exercise.

8. A deep water exercising pool for immersing an exercising person;

said pool having a bottom and side walls;

a body engaging stabilizing means for engaging the person using said pool for stabilizing the person during exercise;

air supply means supported adjacent said pool to supply air to the person from outside the pool.

9. The pool recited in claim 8 further comprising exercising devices which include paddles on the end of handles for swinging in the water to simulate a golf club swing.

10. The pool recited in claim 8 wherein an air supply is supported adjacent said pool and air tubes extend from said air supply into said water and a breathing means is provided to be supported on the face of the person while said person is exercising.

11. The pool recited in claim 10 wherein said exercising devices comprise said exercise device having a means to attach to the head to exercise the neck muscles of a person.

12. The pool recited in claim 10 wherein a supply of air is provided for the person;

said supply of air includes a head set for conducting said air to the person.

13. The pool recited in claim 11 wherein an exercise device includes a helmet and a resistance element on said helmet for neck exercise.

14. The pool recited in claim 9 wherein said devices includes a simulated golf club.

15. A method of exercising in a body of water comprising;

providing an air supply, a body engaging stabilizing device and an aquatic exercise device; and, exercising in the body of water using said air supply and said body engaging stabilizer.

16. The pool recited in claim 6 wherein the air supply means includes air tubes which extend into the pool;

a breathing means is attached to the air tubes and provided to be supported on the face of the individual while the individual is exercising.

17. The pool recited in claim 1 wherein the air supply includes tubes extending from the air supply into the pool;

a breathing means is attached to said air tubes and is to be supported on the face of the person while the person is exercising.

18. The method of exercising recited in claim 15 wherein said air supply means is provided adjacent said body of water and air is provided to a person from outside the body of water.

19. The method of exercising recited in claim 18 further comprising extending air tubes from said air supply into said body of water;

attaching a breathing means to said air tubes;

supporting the breathing means on the face of the person while exercising.

20. The pool recited in claim 1 wherein the exercise device comprises a paddle on the end of a handle for swinging in the water to simulate a golf club swing.

21. The method recited in claim 15 wherein the aquatic exercise device provided comprises a paddle on the end of a handle.

22. The pool recited in claim 6 wherein the golf club simulated device comprises a paddle on the end of a handle.

* * * * *